United States Patent [19]

Schubert et al.

[11] 3,996,832

[45] Dec. 14, 1976

[54] PUNCH FOR PRODUCING HOLES IN FOAMED THERMOPLASTIC CONTAINERS

[75] Inventors: John C. Schubert, Chippewa Falls; Charles B. Case, Eau Claire, both of Wis.

[73] Assignee: Standard Oil Company, Chicago, Ill.

[22] Filed: Apr. 10, 1975

[21] Appl. No.: 566,957

[52] U.S. Cl. ..... 83/686; 83/54; 83/192

[51] Int. Cl.[2] ..... B26F 1/14

[58] Field of Search ..... 83/54, 188, 191–196, 83/686, 687, 685, 50, 55

[56] References Cited

UNITED STATES PATENTS

| | | | |
|---|---|---|---|
| 1,895,589 | 1/1933 | Spatta | 83/685 X |
| 2,781,843 | 2/1957 | Comstock | 83/192 X |
| 2,829,983 | 4/1958 | De Gain | 83/188 X |
| 3,772,946 | 11/1973 | Sarra | 83/188 X |
| 3,848,497 | 11/1974 | Lancaster et al. | 83/192 |

*Primary Examiner*—Frank T. Yost
*Attorney, Agent, or Firm*—Robert R. Cochran; Arthur G. Gilkes; William T. McClain

[57] ABSTRACT

A hole punch having a curved cutting edge of generally the same contour as the surface being punched produces clean holes in wall of foamed plastic containers.

1 Claim, 4 Drawing Figures fig. 2.
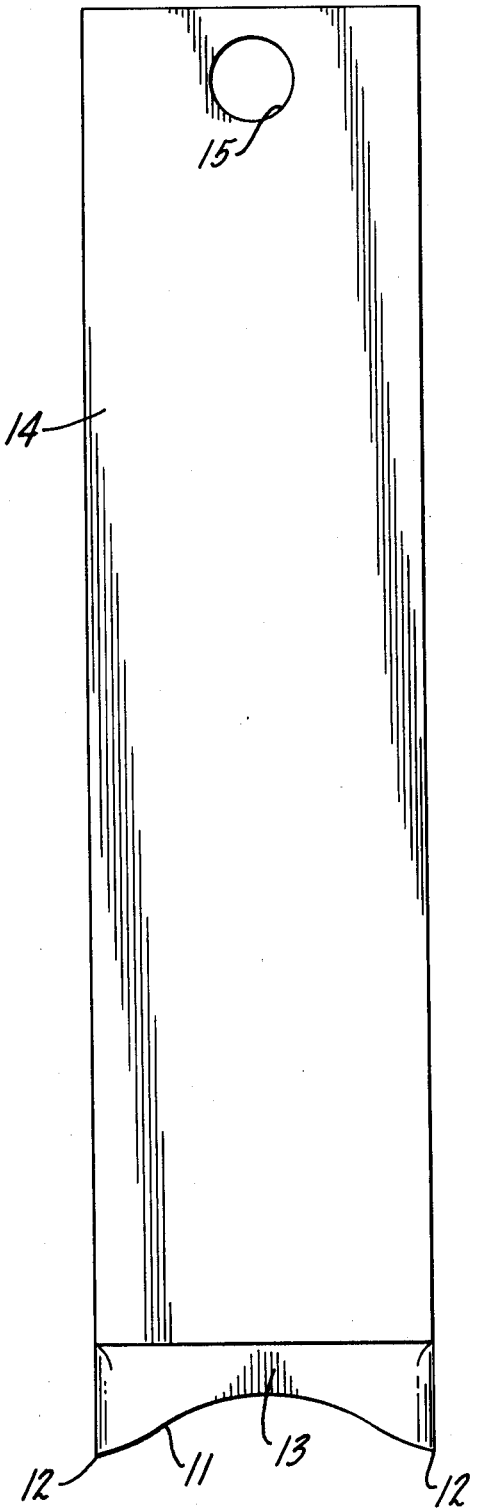
fig. 3.
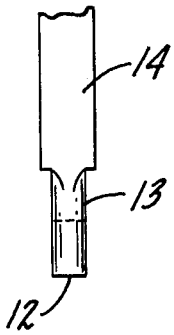
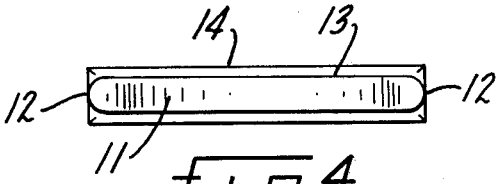
fig. 4.

PUNCH FOR PRODUCING HOLES IN FOAMED THERMOPLASTIC CONTAINERS

BACKGROUND OF THE INVENTION

1. Field of the Invention

This invention relates to the apparatus and method for punching holes in foamed plastic containers. More particularly, it relates to the shape of the cutting edge of the hole punch.

2. Description of the Prior Art

Hole punches as used in the prior art for the purpose of punching holes in foamed plastic containers commonly have cutting blades which are straight. Such a blade is adequate for most purposes where the surface to be punched is a flat surface. However, when such straight blades are used to punch holes in curved surfaces, the result is frequently unsatisfactory, resulting in a hole or slot having ragged and torn edges instead of clean, sharp edges. This probably results from the entire blade failing to contact the surface at the same time, thus creating uneven stresses in the uncut portion of the surface which gives rise to rips and tears.

Accordingly, an object of this invention is to provide a method for producing clean holes in curved surfaces of foamed plastic containers.

A further object of this invention is to provide a new and useful hole punch.

SUMMARY OF THE INVENTION

In one aspect, the invention broadly resides in a hole punch for use in the production of foamed thermoplastic containers, said hole punch comprising a curved blade edge with a contour substantially the same as that of the surface to be punched.

More specifically, the blade edge can be generally concave in shape and have a reverse curvature at both ends of the blade edge.

In a further aspect, the invention resides in a method for punching holes in curved foamed thermoplastic surfaces which comprises positioning the foamed surface between a punch and a die, said punch having a blade edge with substantially the same contour as the foamed surface and said die having substantially the same contour as the backside of said surface and also having a hole adapted to receive the punch, and thrusting the punch through said surface into the die hole, whereby a clean hole or slot is created in said surface.

BRIEF DESCRIPTION OF THE DRAWING

FIG. 2 is a plan view of a preferred hole punch.

FIG. 3 is a fragmentary elevational view of the punch shown in FIG. 2.

FIG. 4 is an end view of the punch shown in FIG. 2.

DESCRIPTION OF THE PREFERRED EMBODIMENT

Figure 1:
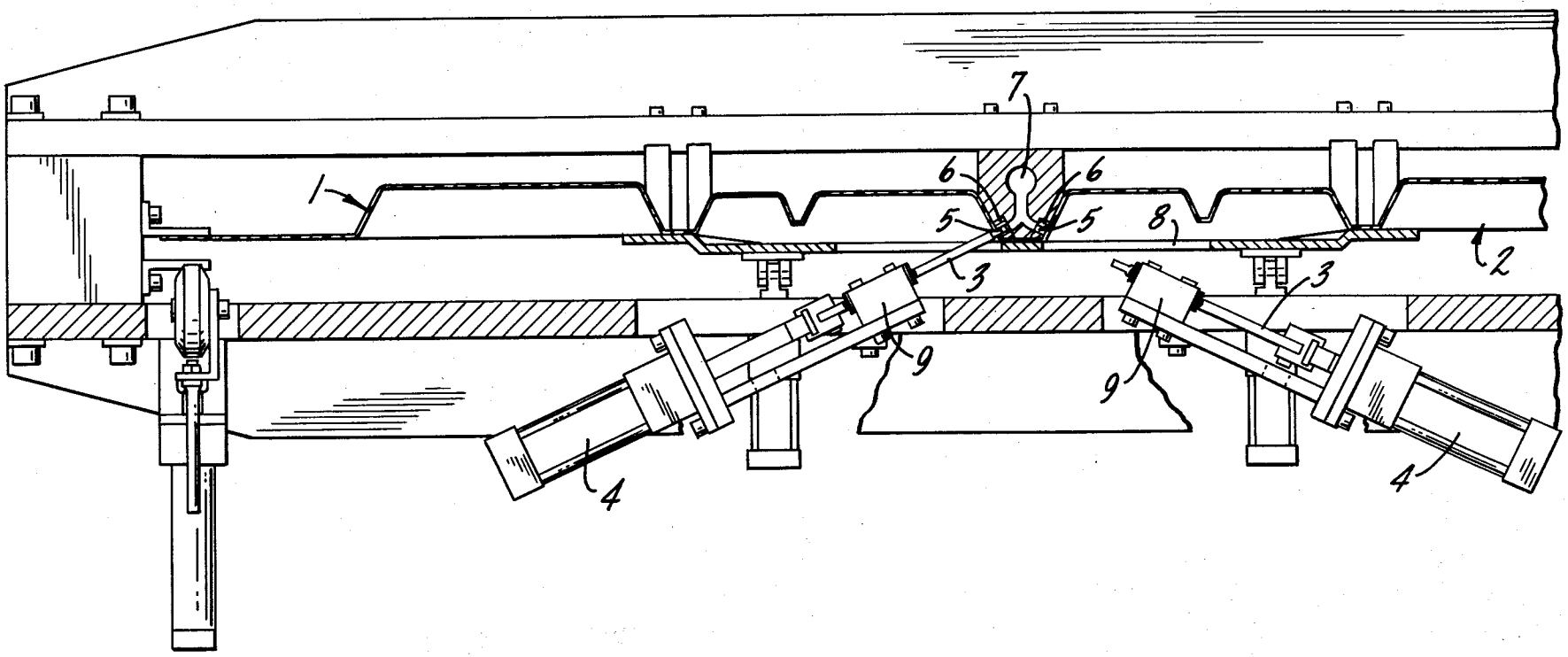
FIG. 1 is a view of the hole punching apparatus viewed from along the line of travel of the containers being punched.

Directing attention to the drawing, our invention will be described in more detail.

FIG. 1 is a view of the hole punching apparatus viewed from along the line of travel of the foamed thermoformed plastic containers which are to be punched. The means for closing these particular containers required a slot to be punched out of a sidewall having an outwardly protruding surface. This closure means is described in a copending application bearing Ser. No. 525,390 filed Nov. 20, 1974, now U.S. Pat. No. 3,935,962, which is hereby incorporated by reference. Shown are two hinged containers 1 and 2, traveling "open side down" and out of the plane of the paper. Both containers are punched simultaneously, although the two punches 3 are shown both in an extended and retracted position for purposes of illustration. As the containers are advanced into proper position, the pneumatic cylinders 4 thrust the punches 3 through the surface to be punched 5 and into the die plate 6, producing a hole or slot in the container wall. The punched material is forced through the die into a hollow chamber 7 which is connected to a vacuum in order to remove all the scraps. The punches are then pneumatically retracted as the containers are advanced and the process is repeated. Also shown are a support 8 for the advancing containers and a punch guide 9.

FIG. 2 is a plan view of a preferred punch as used in the process of FIG. 1 for punching slots in outwardly protruding surfaces of foamed thermoformed containers. Shown is the blade edge 11, the ends 12 of the blade edge, a reduced portion 13 of the shaft 14, and a hole 15 which provides a means of attaching the punch to the pneumatic cylinders. The overall dimensions of the punch are about 6.4 inches in length, 1.5 inches in width, and 0.25 inch in depth. The reduced portion 13 of the shaft has been machined down to provide a better fit into the punch die. The generally concave blade edge 11 has a radius of curvature of 0.875 inch measured at the center of the blade edge. Toward the ends of the blade edge, a reverse curvature is provided to more closely conform to the contour of the surface to be punched. The reverse curvatures also have a radius of curvature of 0.875 inch.

FIG. 3 is a fragmentary elevational view of the punch shown in FIG. 2. Shown is the side of the shaft 14, the reduced portion 13 of the shaft, and the end 12 of the blade edge. This view illustrates the extent to which the reduced portion of the shaft has been machined down.

FIG. 4 is an end view looking at the blade edge. Shown is the shaft 14, the blade edge 11, and the rounded corners of the reduced portion of the shaft.

In using the particular punch and die herein described in the preferred embodiment, two other factors were found to have an effect on the quality of the slot. In particular, best results were achieved when the surface to be punched had a wall thickness greater than 0.08 inch and a foamed cell structure consisting of cells having a generally round shape with an average diameter of at least 0.006 inch, although a wall thickness as thin as 0.045 inch could be used. Preferred upper limits for the wall thickness and cell diameter would be about 0.4 inch and 0.015 inch, respectively. It is important to note that the effect of these factors is dependent upon the closeness of the fit between the punch and die, which in the preferred embodiment has a clearance of about 0.003 to 0.004 inch on each side of the punch. A different clearance would correspondingly change the preferred ranges of the wall thickness and cell diameter, which could easily be optimized with the aid of the broad teachings of this invention.

Accordingly, it will be obvious to those skilled in the art that many variations may be made from the preferred embodiment chosen for purposes of illustration without departing from the scope of this invention.

We claim:

1. A hole punch for use in the production of foamed thermoplastic containers comprising a generally concave blade edge with a reverse curvature near each edge of the blade, said blade edge having generally the same contour as the surface into which it is punched.

* * * * *